United States Patent [19]

Young

[11] 4,121,199

[45] Oct. 17, 1978

[54] SENTINEL SYSTEM FOR GREASE EXTRACTING VENTILATORS

[76] Inventor: Hurshel F. Young, 20280 SW. Jaylee St., Aloha, Oreg. 97005

[21] Appl. No.: 721,517

[22] Filed: Sep. 8, 1976

Related U.S. Application Data

[63] Continuation of Ser. No. 611,238, Sep. 8, 1975, abandoned.

[51] Int. Cl.[2] ..... G08B 21/00

[52] U.S. Cl. ..... 340/611; 126/299 D

[58] Field of Search ..... 340/240, 241, 229, 239 R; 126/299 A, 299 B, 299 D, 299 F; 98/115 K

[56] References Cited

U.S. PATENT DOCUMENTS

| | | | |
|---|---|---|---|
| 2,069,953 | 2/1937 | Hopkins | 340/240 |
| 3,070,676 | 12/1962 | Moseres | 340/239 F X |
| 4,040,042 | 8/1977 | Mayer | 340/239 F |

*Primary Examiner*—John W. Caldwell, Sr.
*Assistant Examiner*—Daniel Myer
*Attorney, Agent, or Firm*—Eugene M. Eckelman

[57] ABSTRACT

Air switches operated by ventilator pressure are used in combination with an electric circuit to cause an indicating light to be energized as long as a selected volume of air is moving through the ventilator per unit of time. A red light and buzzer are employed to indicate a low pressure, and a meter is also employed for visual inspection of the condition of the system. Time delay relays are employed in the circuit in an arrangement to allow the system to reach operating condition and also to prevent functioning of the indicating means by temporary undesirable pressure conditions in the ventilator. The system also includes indicating means in the area of the fan to allow the workman to determine the condition of the system at the fan.

9 Claims, 5 Drawing Figures

SENTINEL SYSTEM FOR GREASE EXTRACTING VENTILATORS

This is a continuation, of application Ser. No. 611,238, filed Sept. 8, 1975, and now abandoned.

BACKGROUND OF THE INVENTION

This invention relates to new and useful improvements in sentinel systems, and particularly pertains to a novel application of such a system in combination with a grease extracting ventilator or like structure.

Grease extracting ventilators utilize forced air fans to remove grease laden air from kitchens or the like and work on the principle of centrifugal force. Their efficiency depends entirely upon the velocity of the air being moved by the fans. At proper velocity, static pressure and cubic feet per minute movement of air, the grease particles are thrown from the air and deposited on the metal of the ventilator and washed away by wash down equipment. When the velocity of air movement drops too low, such as when the fan needs maintenance, the centrifugal force is reduced and the grease is carried up and accumulates on the fan blades, fan housing, and in the duct and usually runs down the outside of the fan housing where it becomes soluble with the roofing. This creates a fire hazard and prevents the owner from getting the desired efficiency.

SUMMARY OF THE INVENTION

According to the present invention and forming a primary objective thereof, a sentinel system is provided that employs means operable by the pressure in the duct of a grease extracting ventilator to indicate the operating condition of the system.

A more particular object is to provide a sentinel system of the type described employing air actuated monitoring means arranged for mounting within the ventilator and capable of operating electrical indicating means showing satisfactory or unsatisfactory operation of the fan system in the ventilator, the sentinel system also employing an air flow meter for visual inspection of the pressure conditions within the ventilator duct collar.

Another object is to provide a sentinel system as described which also includes electrical controls arranged to prevent operation of the indicating means during temporary air pressure fluctuations. Still another object is to provide a sentinel system as described employing indicating means in the area of the fan to allow the workman to determine the condition of the system without making repeated trips from the fan to the main panel of indicating means.

DETAILED DESCRIPTION OF PREFERRED EMBODIMENTS

Figure 1:
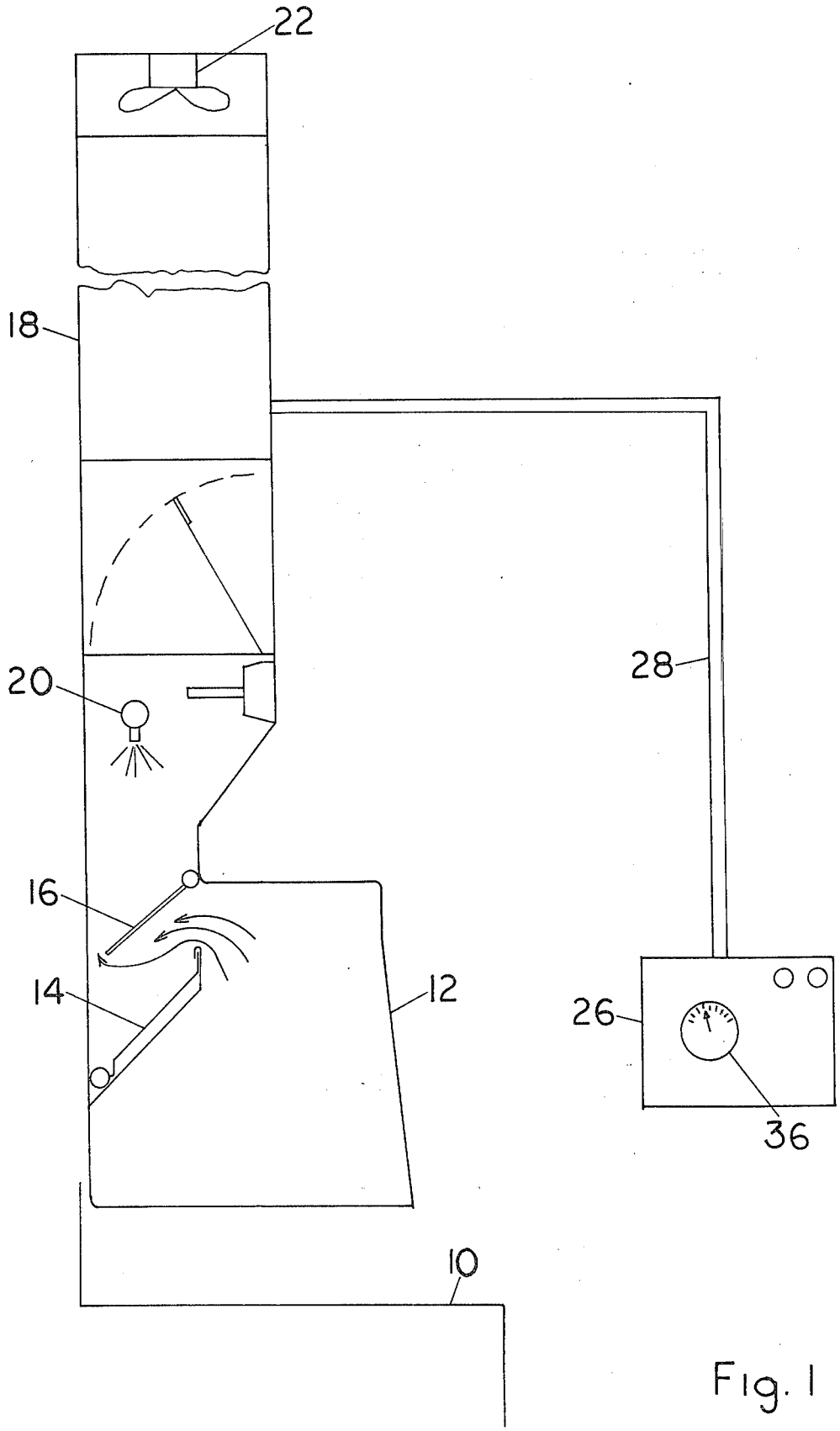
FIG. 1 is a diagrammatic view of a grease extracting ventilator of a type in common use and showing the present sentinel system in association therewith.

The present invention is associated with grease extracting ventilators or the like wherein efficiency of the system depends upon the existence of a selected velocity of air movement, for example, a selected cubic feet per minute air flow. A grease extracting ventilator in common use is shown in FIG. 1 and comprises a grill portion 10 and hood 12. The hood 12 has baffles 14 and 16 and an upwardly extending stack 18. The stack includes wash down nozzles 20 and further includes a suction fan 22 at an upper portion thereof. As stated above, as long as the velocity of the air moving through the stack is proper by efficient operation of the fan, grease particles are deposited on the metal of the ventilator and washed away during the wash cycle. However, if the velocity of the air reduces below a certain force, as by improper operation of the fan 22, the grease is not properly deposited on the ventilator but is carried away such as up to the roof.

Applicant's sentinel system includes a panel box 26 which houses a principal portion of the operating means and circuitry to be described, including a plurality of air switches, to be described, operated by the static pressure in the stack 18. Communication between the stack and the panel box 26 to the air switches is through a suitable conduit 28 in communication at one end with the interior of the stack and leading to the box 26 for connection to the air switches. Panel box 26 is preferably located in the cooking area or other area which makes it readily visible to kitchen personnel or maintenance persons.

Figure 2:
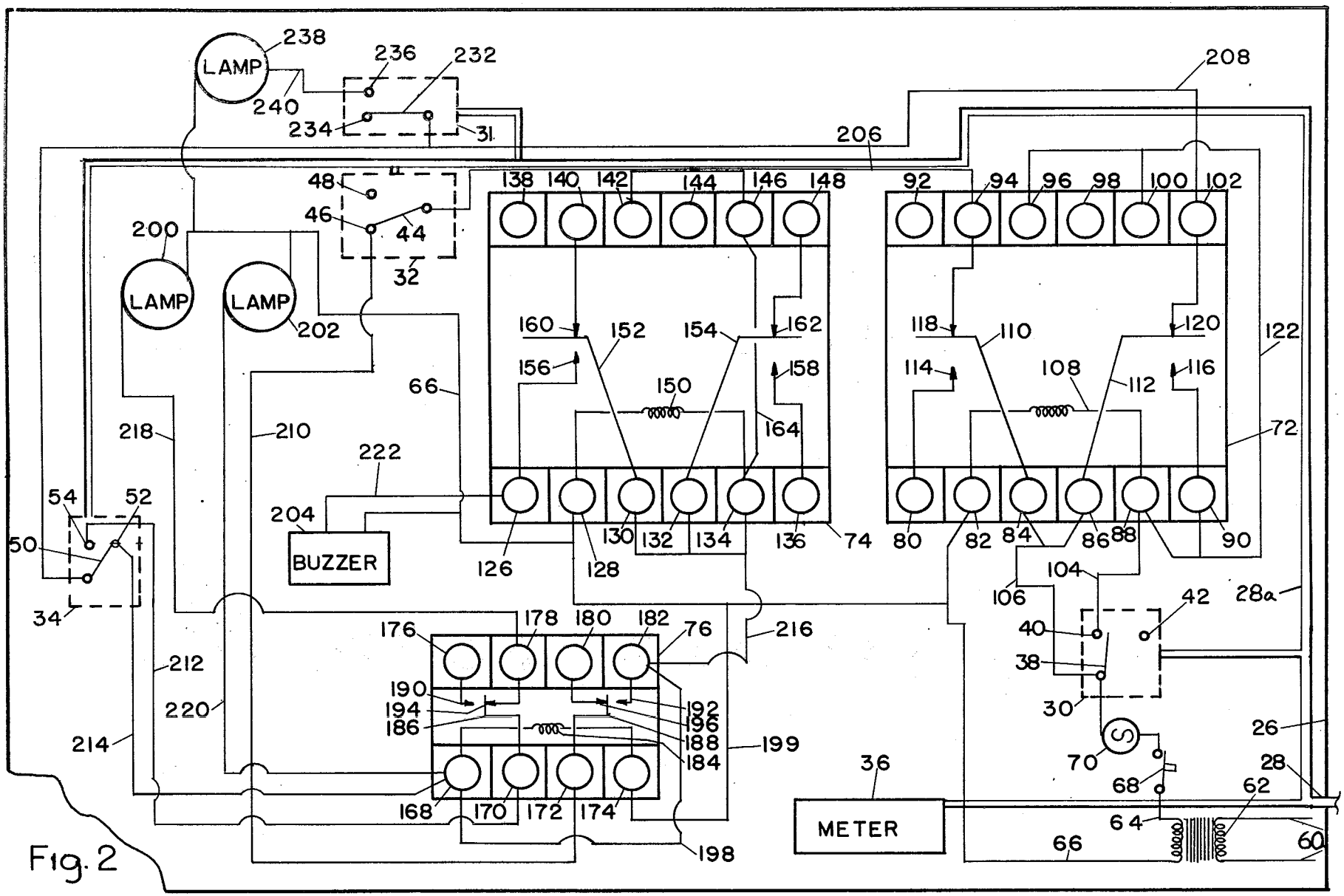
FIG. 2 is a diagrammatic view and wiring layout of a sentinel system embodying a first form of the invention.
Figure 4:
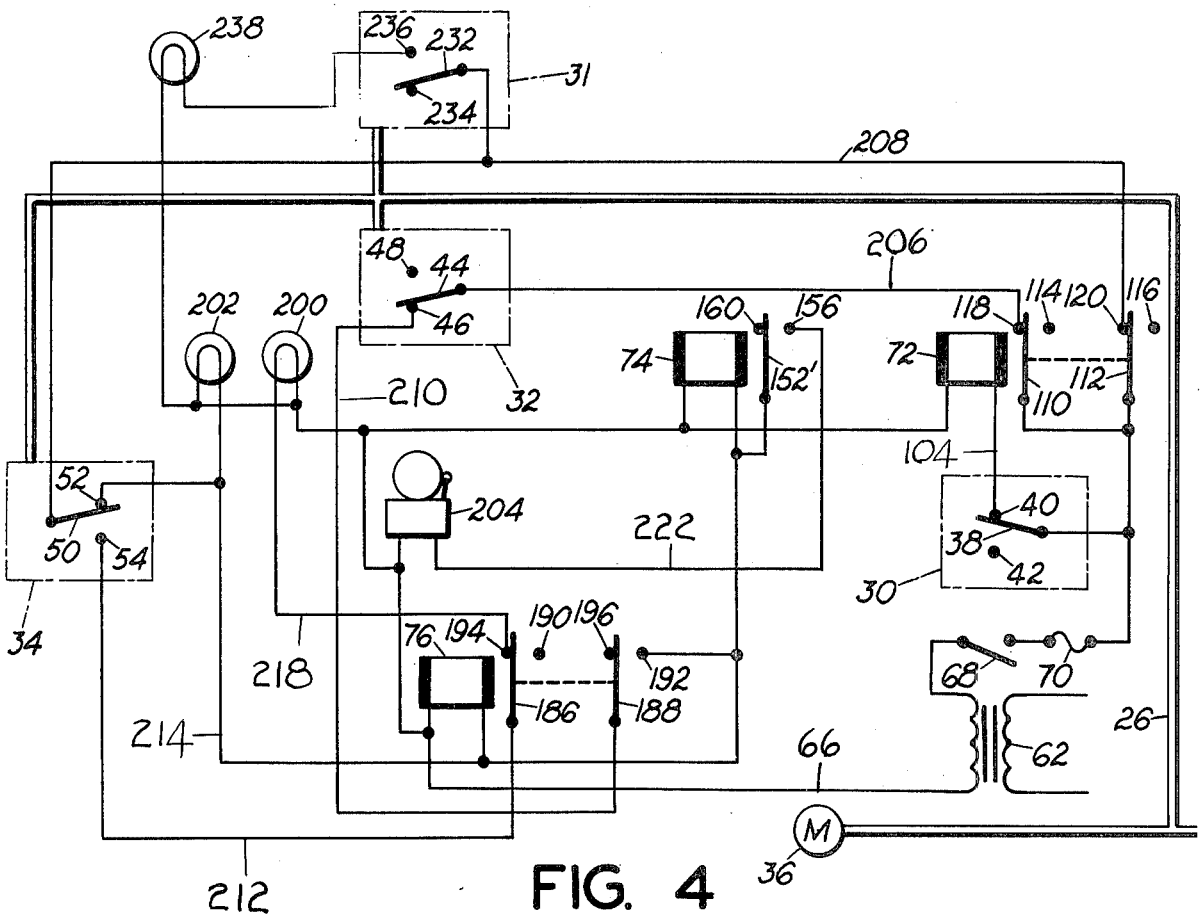
FIGS. 4 and 5 are simplified schematic views of the embodiments of FIGS. 2 and 3, respectively.
Figure 5:
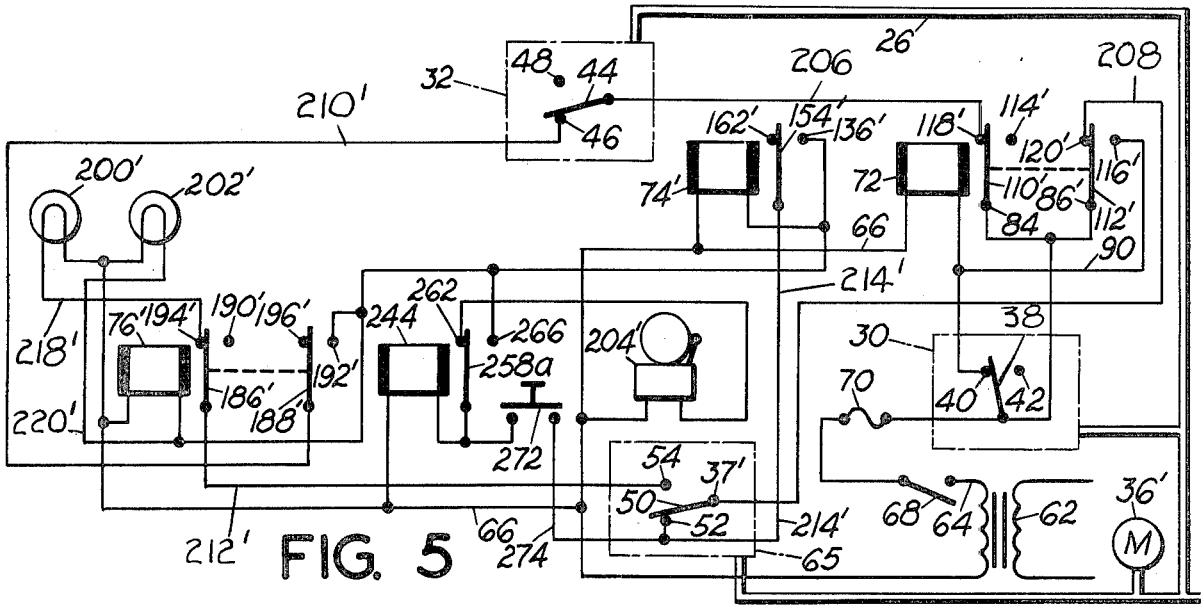

With particular reference to FIGS. 2 and 4, the conduit 28 from the stack leads into panel box 26 and has an extension **28*a* in such box leading to four vacuum operated switches 30, 31, 32, and 34 and to an air flow meter 36, the meter 36, being mounted on the front of panel box 26, FIG. 1, for viewing. For a reason to be more apparent hereinafter, switches 30, 31, 32, and 34 are set to operate at different negative pressures, with the switch 30 operating at a lower negative pressure than both of switches 32 and 34 and the switch 34 operating at a lower negative pressure than switch 32. For example, the operating pressures of switches 30, 32 and 34 respectively may be ½ inch, 1 inch, and 4/5 inch. The setting of switch 31 will be detailed hereinafter. It is apparent that as the negative pressure in the stack builds up from zero, the switch 30 operates first, the switch 34 next and the switch 32 last, and conversely as the said pressure reduces from a proper operating condition, the switch 32 will drop out first, the switch 34 will drop out second, and the switch 30** will drop out last.

Switch 30 has a switch arm 38 normally engaging a contact 40 therein or in other words engaging such contact when the negative pressure in the stack is below the set valve of the switch, or too when the system is off. In the operative condition of the system arm 40 is moved away from contact 40 and engages a stop 42.

Switch 32 has a switch arm 44 normally engaging a contact 46 or in other words engaging such contact when the negative pressure in the stack is below the set valve of the switch or when the system is off. In the pressured operation of the switch 32, arm 44 is moved away from contact 46 and engages a stop 48.

Switch 34 has a switch arm 50 normally engaging a contact 52, or in other words engaging such contact when the negative pressure in the stack is below the set value of the switch or when the system is off. In the pressured operation of switch 34, arm 50 is moved away from contact 52 and engages a contact 54.

The electrical circuitry for the present system includes infeed lines 60 to a transformer 62 the secondary of which has feed lines 64 and 66, respectively, comprising a low source of voltage such as 24 volts for the system. Wire 64 leads to the base of contact arm 38 of switch 30 and has an on-off switch 68 and a fuse assembly 70 therein.

The system incorporates three relays 72, 74 and 76, the relays 72 and 74 being time delay relays. Relay 72 has a first set of terminals 80, 82, 84, 86, 88 and 90 and a second set of opposite terminals 92, 94, 96, 98, 100 and 102. A wire 104 extends from contact 40 of switch 30 to terminal 88 and a wire 106 extends from switch arm 38 to both terminals 84 and 86. Feed line 66 from transformer 62 leads to terminal 82, and the coil 108 of relay 72 is connected to this terminal 82 and to terminal 88. A pair of armature arms 110 and 112 in relay 72 have engagement with contacts 114 and 116, respectively, in the energized condition of the relay and have engagement with contacts 118 and 120, respectively, in the deenergized condition of the relay. Contacts 114 and 116 are connected electrically to terminals 80 and 90, respectively, and contacts 118 and 120 are connected electrically to terminals 94 and 102, respectively. A seal-in circuit 122 for relay 72 extends between terminals 88, 90, 96 and 100, and such circuit when once activated will hold the relay 72 in energized condition until it times out, for example, 1½ minutes or for an appropriate time which as will be seen hereinafter is sufficient to allow the stack pressure to develop from start to the desired level. The seal-in circuit and other relay parts are not detailed in view of their conventional structure.

Relay 74 has a first set of terminals 126, 128, 130, 134 and 136 and a second set of opposite terminals 138, 140, 142, 144, 146 and 148. The coil 150 of this relay is connected to terminals 128 and 134, and armature arms 152 and 154 have engagement with contacts 156, and 158, respectively, in the energized condition of the relay and have engagement with contacts 160 and 162, respectively, in the deenergized condition of the relay. Contacts 156 and 158 are electrically connected to terminals 126 and 136, respectively, and contacts 160 and 162 are electrically connected to terminals 140 and 148, respectively. A seal-in circuit 164 extends between terminals 134, 142 and 146 and such circuit when once activated will hold the relay 74 in energized condition until it times out, for a purpose to be explained hereinafter. Terminal 128 is connected to feed line 66.

Relay 76 has a first set of terminals 168, 170, 172 and 174 and a second set of opposite terminals 176, 178, 180 and 182. The coil 184 of this relay is connected to terminals 168 and 174 and armature arms 186 and 188 have engagement with contacts 190 and 192, respectively, in the energized condition of this relay and have engagement with contacts 194 and 196, respectively, in the deenergized condition of the relay. Contacts 190 and 192 are connected to terminals 176 and 182, respectively, and contacts 194 and 196 are connected to terminals 178 and 180, respectively. Terminals 168 and 182 are connected electrically by a by-pass wire 198 and terminal 174 is connected to feed line 66.

Incorporated in the system is a light 200 comprising an efficiency light that designates, when lighted, a proper operating condition of the system. Also incorporated in the system is a light 202 comprising a trouble light that is lighted when the static pressure in the stack is below its operating level. Furthermore, an audible signal such as a buzzer 204 is employed in the system to also designate trouble.

Electric circuitry for the components described comprises a wire 206 extending from terminal 94 of relay 72 to the base of switch arm 44 of pressure switch 32 and a wire 208 extending from terminal 102 of relay 72 to the base of arm 50 of pressure switch 34. A wire 210 extends from contact 46 of pressure switch 32 to terminal 172 of relay 76.

A wire 212 extends from contact 54 of pressure switch 34 to terminal 170 of relay 76, and a wire 214 extends from contact 52 of this same switch to terminal 168. A wire 216 extends from terminal 182 of relay 76 to terminals 130, 132 and 134 of relay 74. Efficiency light 200 is electrically connected to feed line 66 and to terminal 178 of relay 76 by wire 218 and trouble light 202 is electrically connected to feed line 66 and to terminal 168 of this same relay by a wire 220. Buzzer 204 is electrically connected to feed line 66 and to terminal 126 by a wire 222. Switch 31 has a switch arm 232 normally engaging a stop 234 or in other words normally engaging such stop when the negative pressure in the stack is below the set value of the switch or when the system is off. In the pressured condition of the switch 31, arm 232 is moved away from stop 234 and engages a contact 236. Arm 232 is connected to wire 208. Switch 31, like the other pressure sensitive switches in the system, has a selected operating pressure and for a reason to be more apparent hereinafter it is set to operate at a greater negative pressure than the other switches, for example, 1¼ inches.

An indicating light 238 mounted in the area of the fan is electrically connected to feed line 66 and to contact 236 of switch 31 by a wire 240 and is provided for the purpose of allowing the workman to readily adjust the fan to its proper working condition while staying at the fan, as will be more apparent hereinafter.

With regard to the operation of the present system, switch 68 is normally closed and the system is activated by switch means, not shown, that admits power to transformer 62 and to the fan 24 as well. Switch 68 is utilized generally only when it is desired to deactivate the sentinel and keep the fan in operation. At the moment the system is turned on and for a short while thereafter, namely, until such time that the static pressure operates switch 30, it is apparent that arm 38 of switch 30 will be in engagement with contact 40. The coil 108 of relay 72 will be immediately energized by the circuit through arm 38, contact 40, wire 104, and terminals 88 and 82 to feed line 66. This will cause engagement of armature arms 110 and 112 with their respective contacts 114 and 116 and no current exists beyond relay 72. Seal-in circuit 122 will also be energized at the beginning of operation and the relay will begin its timing cycle. Arm 38 of switch 30 will move over to stop 42 as soon as the negative pressure develops in the stack equal to the setting of such switch but since the relay is sealed in by its seal-in circuit, it will operate through its time cycle in energized condition.

When the relay 72 deenergizes, circuits are then established to both switches 32 and 34, as well as to switch 31. Such circuits extend through wire 106 from switch 30, terminal 84, armature arm 110, contact 118, terminal 94, and wire 206 to switch 32, and through wire 106, terminal 86, armature arm 112, contact 120, terminal 102, and wire 208 to switches 31 and 34. For the present, it will be assumed that the stack pressure is satisfactory, whereby arm 44 of switch 32 will have moved into engagement with stop 48 and arm 50 of switch 34 will have moved into engagement with contact 54. The circuit in wire 206 dead-ends at arm 44. A circuit is established in wire 208, contact arm 50 of switch 34, contact 54, wire 212, terminal 170 of relay 76, contact arm 186, contact 194 and terminal 178 of this same relay, wire 218, efficiently light 200 and lead wire 66. Thus, with the system in proper operation, efficiency light 200 will be lighted to show such proper operation. Of course, the static pressure can be determined by viewing the meter 36 but light 200 gives visual indication of proper operating condition from a distance.

In the event that the fan malfunctions or the static pressure in the stack otherwise changes so as not to be at its desired operating level, arm 44 of switch 32 moves into engagement with contact 46. At this position of the switch 32, the status of relay 76 does not change since the circuit from such switch exists only in wire 210 and said circuit dead-ends at terminal 180 thereof. However, as the static pressure reduces further, arm 50 of switch 34 moves over onto contact 52. This interrupts the circuit to wire 212 and the efficiency light 200 turns off. At the same time a circuit is established in wire 214, and the relay 76 is energized by the circuit through wire 214, terminal 168, coil 184, terminal 174 and feed line 66. This condition of relay 76 turns on the trouble light by the circuit established through wire 214, terminal 168 of relay 76, wire 220, light 202, and feed line 66.

Furthermore, by the energization of relay 76, time delay relay 74 will also be energized by the circuit through wire 214, terminal 168, by-pass wire 198, terminal 182, wire 216, terminal 134 of relay 74, coil 150, terminal 128, and feed line 66. The buzzer 204 is activated when the relay 74 is energized by a circuit through wire 216, terminal 130 of relay 74, armature arm 152, contact 156, terminal 126, wire 222, buzzer 204, and feed line 66. Relay 74 will remain energized by its seal-in circuit 164 until it times out and thus the buzzer will sound continuously until the end of the timed cycle. When the relay 74 deenergizes, the buzzer will stop. The relay 76, however, will remain energized since a circuit is established to said coil through switch 32, wire 210, terminal 172, armature arm 188, contact 192, terminal 182, wire 198, terminal 168, terminal 174, and line 199 to feed line 66. The trouble light 202 will thus remain lighted until the system is shut off or until the fan is speeded up to the point where wires 210 and 214 are cut off from the source through relay 72. Thus, if the system does not correct itself, a constant warning is maintained by the light 202 that trouble exists.

Once the relay 76 is energized, it will have a seal-in circuit as just described through switch 32 and thus there will be no rocking on and off of the light 202 and buzzer 204 if the static pressure varies close above and below the setting of switch 34 and the latter is repeatedly opening and closing. Thus, once the switch 34 causes the efficiency light 200 to turn off and the trouble light 202 and buzzer 204 to turn on, the light 202 will stay on until the system is shut off or the pressure in the stack is corrected.

Air switch 31 is utilized for the convenience of the workman to allow him to readily adjust the fan without traveling up and down between the fan 24 and the panel box 26. That is, the light 238 is mounted in the area of the fan 24, and being in the circuit with efficiency light 200 it will be lighted when the conditions are proper. The workman in making the adjustment accomplishes such adjustment of whatever is faulty to cause the switch 232 to move into engagement with contact 236, thus completing the circuit to light 238, namely, from wire 208 through arm 232, contact 236, wire 240 and through said light to feed line 66. As stated hereinbefore, the pressure setting of switch 31 is greater than the other switches. Preferably such setting is at the top of the pressure range so that when adjustment is made while at the fan to the extent that the light 238 is lighted, the workman is sure that the system is operating satisfactorily. He does not thus have to go up and down between the fan and the panel box during the adjusting process and much time is saved.

Figure 3:
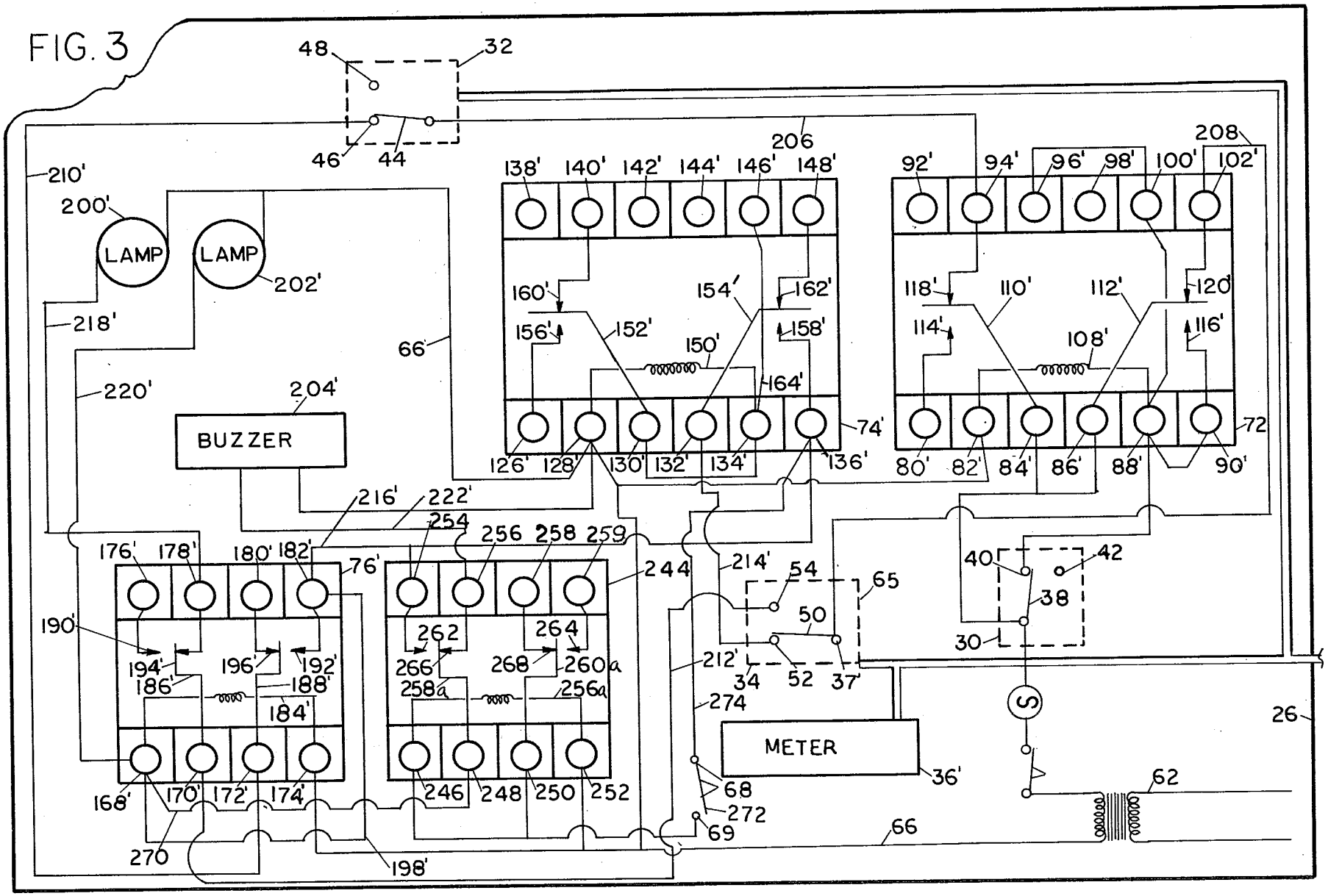
FIG. 3 is a view similar to FIG. 2 but showing a modification of the invention.

Referring to FIGS. 3 and 4, a second embodiment of the invention is provided and employs a circuit somewhat similar to that shown in FIG. 2 except means are provided for shutting off the buzzer 204 prior to the time that its relay 74 times out. That is, it may be desired that the buzzer not ring for a minute and a half or whatever the timed sequence of relay 74 is. Rather than merely providing an on/off switch to the buzzer which would have the disadvantage that such switch may not get turned on again after the system had been rendered operative, the buzzer is incorporated in a modified circuit that provides a turnoff therefor but at the same time it is maintained in the circuit for automatic reincorporation in the circuit.

The embodiment of FIG. 3 utilizes the three air switches 30, 32 and 34 in the same manner as in the FIG. 1 embodiment and the circuit from transformer 62 up through the relay 72 and to the air switches 32 and 34 is identical. The system also employs an air flow meter 36', an efficiency light 200', a trouble light 202' and a buzzer 204'. The air switch 31 and its indicating light 238 of FIG. 1 are not illustrated in FIG. 3, but such components could as well be used with this embodiment.

Relay 74' has a first set of terminals 126', 128', 130', 134' and 136' and a second set of opposite terminals 138', 140', 142', 144', 146' and 148'. The coil 150' of this relay is connected to terminals 128' and 134', and armatures arms 152' and 154' have engagement with contacts 156' and 158', respectively, in the energized condition of the relay and have engagement with contacts 160' and 162' respectively in the deenergized condition of the relay. Contacts 156' and 158' are connected to terminals 126' and 136' respectively and contacts 160' and 162' are connected to terminals 140' and 148' respectively. The numeral 164' designates the seal in circuit and once energized, the relay 74' will remain in such condition until it times out and the buzzer will ring during the time. Terminal 128' is connected to feed line 66.

Relay 76' has a first set of terminals 168', 170', 172' and 174' and a second set of opposite terminals 176', 178', 180' and 182'. The coil 184' of this relay is connected to terminals 168' and 174' and armature arms 186' and 188' are in engagement with contacts 190' and 192' respectively in the energized condition of this relay and have engagement with contacts 194' and 196' respectively in the deenergized condition of the relay. Contacts 190' and 192' are connected to terminals 176' and 182' respectively and contacts 194' and 196' are connected to terminals 178' and 180' respectively. Terminals 168' and 182' are connected electrically by a by-pass wire 198' and terminal 174' is connected to feed line 66.

Also incorporated in the FIG. 3 embodiment is a relay 244 having a first set of terminals 246, 248, 250, 252 and a set of opposite terminals 254, 256, 258 and 259. The coil **256*a* of this relay is connected to terminals 246 and 252 and armature arms 258*a* and 260*a*** are in engagement with contacts 262 and 264 respectively in the energized condition of the relay and have engagement with contacts 266 and 268 respectively in the deenergized condition of the relay. Contact 252 is connected to feed line 66.

Electric circuitry for the components described comprises a wire 210′ extending from arm 44 with pressure switch 32 to terminal 172′ of relay 76′. A wire 212′ extends from contact 54 of pressure switch 34 to terminal 170′ of relay 76′ and a wire 214′ extends from contact 52 to terminals 130′ 132′ and 134′ of relay 74′. A wire 216′ extends to terminal 136′ of relay 74′ and also to terminals 254 and 260 of relay 244.

Efficiency light 200′ is electrically connected to feed line 66 and to terminal 178′ of relay 76′ by wire 218′ and trouble light 202′ is electrically connected to feed line 66 and to terminal 168′ of this same relay by a wire 220′. Buzzer 204′ is electrically connected to one side to feed line 66 and on the other side to terminal 256 of relay 244 by means of a wire 222′. A wire 270 is connected between terminal 168′ of relay 76′ and terminal 248 of relay 244.

A normally open push button switch 272 is incorporated in a wire 274 connected at one end to terminal 136′ of relay 74′ and at its other end to terminals 246 and 250 of relay 244.

In the operation of the FIG. 3 embodiment, relay 72 operates the same as in FIG. 1 wherein when it times out current is supplied to wires 206 and 208 leading respectively to air switches 32 and 34. If the stack pressure is satisfactory, switch arm 44 of switch 32 engages stop 48 and no current passes through the switch and arm 50 of switch 34 engages contact 54 and the efficiency light 200′ is turned on by the circuit from wire 208, through the switch 34, wire 212′, terminal 170′ of relay 76′, armature arm 186′, contact 194′, terminal 178′, wire 218′, the light 200′ and feed line 66.

When the static pressure in the stack reduces below a desired operating level, arm 44 of switch 32 moves into engagement with the contact 46. Although current is admitted to wire 210′, this circuit is still dead ended in terminal 180′ and relay number 3 is not energized. However, as the static pressure in the stack further reduces, the arm 50 of switch 34 moves onto contact 52 and the circuit to light 200′ is broken. Time delay relay 74′ and relay 76′ are both energized at this time. Relay 74′ is energized by a circuit from contact 52 of switch 34 through wire 214′, terminal 134′, coil 150′, terminal 128′, and to feed line 66. With the energization of relay 74′ a circuit is also established in contact 52 of switch 34 through wire 214′, terminal 132′, armature arm 154′, contact 158′, terminal 136′, wire 216′, terminal 182′ of relay 76′, wire 198′, terminal 168′, coil 184′, terminal 174′, and feed line 66. The buzzer 204 is simultaneously turned on by a circuit through contact 52 of switch 34, wire 214′, terminal 132′, armature arm 154′, contact 158′, terminal 136′, wire 216′, terminal 182′, wire 198′, terminal 168′, wire 270, terminal 248 through to terminal 256, wire 222′, buzzer 204′, and to feed line 66. The buzzer will stay on until the relay 74′ deenergizes whereby its circuit through the arm 154′ of this relay will be broken.

Light 202′ will also light when trouble occurs, and the circuit to the light is through contact 46, wire 210′, terminal 172′, through to terminal 182′, wire 198′, terminal 168′, wire 220′, light 202′, and feed lines 66.

Light 202′ stays lighted as long as relay 76′ is energized, and this latter relay once energized will remain in that condition until switch arm 44 is moved to contact 48 or until the system is shut off, and such seal-in circuit exists through contact 46 of switch 32, wire 210′, terminal 172′ through to terminal 182′, wire 198′, terminal 168′, through the coil 184′, and to the lead line 66. The light 202′ will remain lighted as long as the relay 76′ is energized.

The primary function, as described above, of the FIG. 3 embodiment is to shut off the buzzer 204′ before the relay 74′ times out. Shutting off the buzzer 204′ is accomplished by closing switch 272. It is apparent from the diagram that the wire 274 in which the switch 272 is incorporated is in circuit with the coil 256*a* of relay 244, and upon closing of the switch, a circuit to the coil 256 is established. Energizing relay 244 breaks contact 266 from arm 258 shutting off the buzzer. This in turn makes the circuit between terminal 250, arm 260 and terminal 246 which seals in the coil of relay 244. Thus, when the operator is alerted to the fact that the stack pressure is not proper, by a ringing of the buzzer, he can turn the buzzer off in the event that such is desired.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A sentinel system for sensing fluid pressure in a stack of the type having a fan developing static pressure, said system comprising,
   (a) first and second pressure operated switches,
   (b) means arranged to connect said switches in communication with the interior of said stack,
   (c) said two switches having different static operating pressures with said second switch being set to operate at a lower static pressure than said first switch,
   (d) an electric circuit,
   (e) an electrically operated warning indicating means in said circuit having on and off conditions,
   (f) said indicating means being controlled in its operation by said second switch and indicating undesirable static pressure in the stack,
   (g) and holding means in said circuit controlled in its operation by said first switch for holding said warning indicating means in on position even though the static pressure varies above and below the setting of said second switch.

2. The sentinel system of claim 1 including an audible signal in said circuit controlled in its operation by said second switch to designate undesirable static pressure in the stack.

3. The sentinel system of claim 1 including an efficiency light in said circuit operated by said second switch to show a satisfactory static pressure in the stack.

4. The sentinel system of claim 1 including a trouble light in said circuit operated by said second switch to show an unsatisfactory static pressure in the stack.

5. The sentinel system of claim 1 including an efficiency light in said circuit operated by said second switch to show a satisfactory static pressure in the stack, and a trouble light in said circuit also operated by said second switch to show an unsatisfactory static pressure in the stack.

6. The sentinel system of claim 1 wherein said holding means is structurally arranged to maintain said warning indicating means in on condition until the static pressure is raised to the setting of said first switch.

7. The sentinel system of claim 1 including a third pressure operated switch arranged to be connected with the interior of the stack, said switch having a higher static operating pressure than said first switch, and indicating means in said circuit controlled in its operation by said third switch, said indicating means being arranged to be mounted adjacent to the stack at the fan.

8. The sentinel system of claim 1 including an audible signal in said circuit controlled in its operation by said second switch, and relay means maintaining said audible signal in a timed on condition even though the static pressure has been corrected.

9. The sentinel system of claim 8 including a manual switch in the circuit to said audible signal for turning it off prior to the completion of the timed on condition thereof by said relay means.

* * * * *